US007288230B2

(12) United States Patent
Grandlund et al.

(10) Patent No.: US 7,288,230 B2
(45) Date of Patent: Oct. 30, 2007

(54) CATALYTIC CONVERTER UNIT AND APPARATUS

(75) Inventors: Ulf Grandlund, Vaasa (FI); Ulf Nordmyr, Sundom (FI)

(73) Assignee: Wartsila Finland Oy, Vaasa (FI)

( * ) Notice: Subject to any disclaimer, the term of this patent is extended or adjusted under 35 U.S.C. 154(b) by 649 days.

(21) Appl. No.: 10/699,525

(22) Filed: Oct. 30, 2003

(65) Prior Publication Data

US 2004/0126289 A1 Jul. 1, 2004

(30) Foreign Application Priority Data

Nov. 4, 2002 (FI) ..... 20021962

(51) Int. Cl.
*F01N 3/28* (2006.01)
*F01N 3/10* (2006.01)

(52) U.S. Cl. ..... 422/177; 422/169; 422/171; 422/176

(58) Field of Classification Search ..... None
See application file for complete search history.

(56) References Cited

U.S. PATENT DOCUMENTS 2,811,425 A * 10/1957 Houdry ..... 422/171
3,083,083 A 3/1963 Boysen
3,736,105 A * 5/1973 Tourtellotte et al. ..... 422/171
4,625,511 A 12/1986 Scheitlin et al.
2003/0108457 A1 6/2003 Gault et al.

FOREIGN PATENT DOCUMENTS

| | | |
|---|---|---|
| DE | 24 17 435 | 10/1975 |
| DE | 198 55 093 | 5/2000 |
| EP | 1 215 375 | 6/2002 |
| FR | 1 257 056 | 2/1960 |
| FR | 1 268 668 | 8/1961 |
| JP | 10110616 A * | 4/1998 |
| WO | WO 0142630 A2 * | 6/2001 |

* cited by examiner

*Primary Examiner*—Glenn Caldarola
*Assistant Examiner*—Jennifer A. Leung
(74) *Attorney, Agent, or Firm*—Smith-Hill and Bedell

(57) ABSTRACT

A catalytic converter unit includes walls defining a treatment zone, first and second transfer zones and at least one through-flow zone, which zones are adjacent each other. The walls include a partition wall that divides the treatment zone into first and second segments. The first transfer zone is plugged upstream of the partition wall and the second transfer zone is plugged downstream of the partition wall. A catalytic converter element is disposed in the first segment of the treatment zone, spaced from the partition wall. The first segment of the treatment zone is in flow communication with the first transfer zone and the second segment of the treatment zone is in flow communication with the second transfer zone.

8 Claims, 3 Drawing Sheets

CATALYTIC CONVERTER UNIT AND APPARATUS

CROSS REFERENCE TO RELATED APPLICATION

This application claims priority under 35 USC 119 of Finnish Patent Application No. 20021962 filed Nov. 4, 2002.

BACKGROUND OF THE INVENTION

This invention relates to a catalytic converter unit and to a catalytic converter apparatus.

It is well-known that energy production plants produce gases, the composition of which needs to be changed before they are released to the atmosphere. The exhaust gases from a combustion process are specifically such gases. For treating certain components in the exhaust gases, such as nitrogen oxides and hydrocarbons, the exhaust gas flow is arranged to pass through a catalytic converter. Especially when large exhaust gas volumes are concerned, the physical size of the structures involved easily exceeds the desired size.

It is also essential for the operation of the catalytic converter that the flow rate of the exhaust gases therein is not too high, i.e. the retention or residence time of the gas in the catalytic converter should be long enough for the desired reactions to take place. In order to accomplish this, it is conventional to employ a parallel connection of several catalytic converter elements. Alternatively a single catalytic converter element with a large diameter may be used. In the event that either conventional approach is utilized to provide a sufficiently large cross-sectional area of catalytic converter element(s), the size of the plant is further increased.

An aim of the present invention is to provide a catalytic converter arrangement, by which considerable space saving is achieved particularly in conjunction with a combustion engine by utilizing the length of the exhaust gas apparatus. An aim of the invention is also to provide such a catalytic converter unit that makes a space-saving catalytic converter apparatus of modular design feasible.

SUMMARY OF THE INVENTION

In accordance with a first aspect of the invention there is provided a catalytic converter unit comprising a wall means defining a treatment zone, first and second transfer zones and at least one through-flow zone, wherein the zones are adjacent each other, the wall means includes a partition wall that divides the treatment zone into first and second segments, the first transfer zone is plugged upstream of the partition wall and the second transfer zone is plugged downstream of the partition wall, and a catalytic converter element disposed in the first segment of the treatment zone, spaced from the partition wall, and wherein the first segment of the treatment zone is in flow communication with the first transfer zone and the second segment of the treatment zone is in flow communication with the second transfer zone.

In a catalytic converter unit embodying the invention the gas to be treated may be divided into at least a first stream that is conducted past a catalytic converter element arranged in a given catalytic converter unit and a second stream that is conducted through the catalytic converter element arranged in the given catalytic converter unit, whereby only one stream is treated by the catalytic converter element of the given catalytic converter unit. The catalytic converter elements may be connected in parallel with respect to the gas flow. The catalytic converter unit comprises several zones arranged next to each other, i.e. laterally of the longitudinal axis. One of the zones is a treatment zone in which the catalytic converter element is located and where a partition wall is arranged at a distance from the catalytic converter element. In addition, the catalytic converter unit comprises a first transfer zone and a second transfer zone, which are plugged substantially at their opposite ends, and at least one through-flow zone. Furthermore, the treatment zone is in flow communication with the first transfer zone on one side of the partition wall and with the second transfer zone on the other side of the partition wall. A catalytic converter unit of this nature provides a compact assembly of modular structure.

It is preferred that the treatment zone of the catalytic converter unit be bounded by a common partition wall having portions that bound the two transfer zones and the through-flow zone or zones. Preferably, the treatment zone is disposed centrally in the cross-section of the catalytic converter unit so that it is surrounded by the other zones. The structure is designed so that the first and second transfer zones share a common partition wall, i.e. they are located next to each other.

In accordance with a second aspect of the invention there is provided a catalytic converter apparatus having an inlet end and an outlet end, the catalytic converter apparatus including a plurality of catalytic converter elements, and a wall means defining a treatment zone having a plurality of successive longitudinal segments in which the catalytic converter elements are respectively disposed, and gas feed zones arranged about the segments of the treatment zone for conducting gas to the segments of the treatment zone.

In accordance with a third aspect of the invention there is provided a catalytic converter apparatus including a plurality of catalytic converter units connected end-to-end between an inlet end of the apparatus and an outlet end thereof, each catalytic converter unit comprising a wall means defining a treatment zone, first and second transfer zones and at least one through-flow zone, wherein the zones are adjacent each other, the wall means includes a partition wall that divides the treatment zone into first and second segments, the first transfer zone is plugged upstream of the partition wall and the second transfer zone is plugged downstream of the partition wall, and a catalytic converter element disposed in the first segment of the treatment zone, spaced from the partition wall, and wherein the first segment of the treatment zone is in flow communication with the first transfer zone and the second segment of the treatment zone is in flow communication with the second transfer zone.

A catalytic converter apparatus embodying the invention for conducting the gas to be treated through several catalytic converter elements that are connected in parallel with respect to the gas flow comprises, when viewed in cross-section, several zones extending substantially from the gas inlet end of the apparatus to the outlet end thereof, and a treatment zone for gas, in which several successive catalytic converter elements are arranged, and feed zones arranged laterally of the treatment zone and symmetrically with respect to its longitudinal axis for conducting gas to each catalytic converter element. The feed zones comprise at least one zone which is plugged between the gas inlet end and the gas outlet end of the catalytic converter apparatus, and a flow path that bypasses the plug is arranged in the treatment zone via the catalytic converter element.

Preferably the treatment zone is centrally arranged in the catalytic converter apparatus and the feed zones surround the treatment zone. Preferably, the catalytic converter apparatus has a circular cross-section, and the treatment zone is centrally arranged in the catalytic converter apparatus and the other zones are formed of annular sectors surrounding the treatment zone.

An embodiment of the present invention is particularly advantageous in conjunction with a large piston engine where the catalytic converter units to be arranged one after the other extend over the length of the engine.

BRIEF DESCRIPTION OF THE DRAWINGS

In the following the invention is described by way of example with reference to the attached drawings, in which.

DETAILED DESCRIPTION

Figure 1:
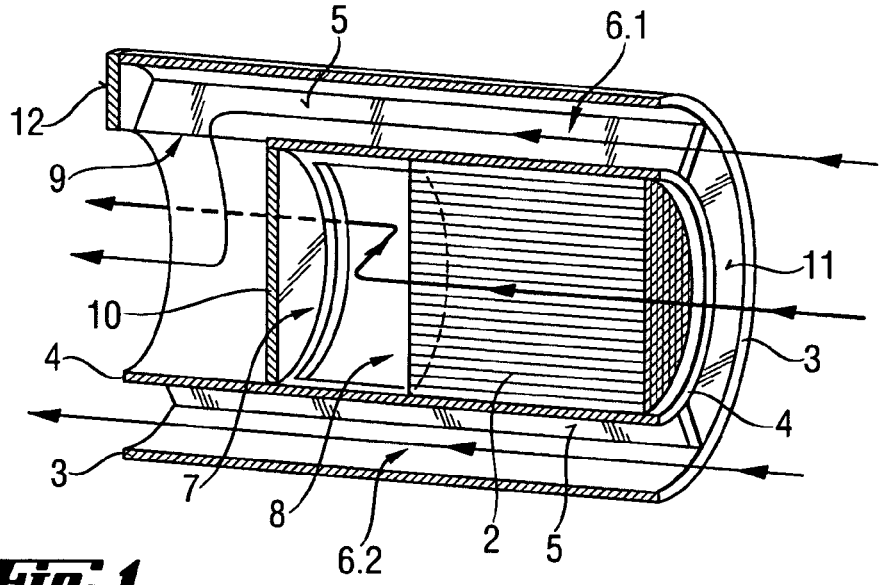
FIG. 1 shows the cross-section of a catalytic converter unit embodying the invention in the longitudinal direction thereof.
Figure 2:
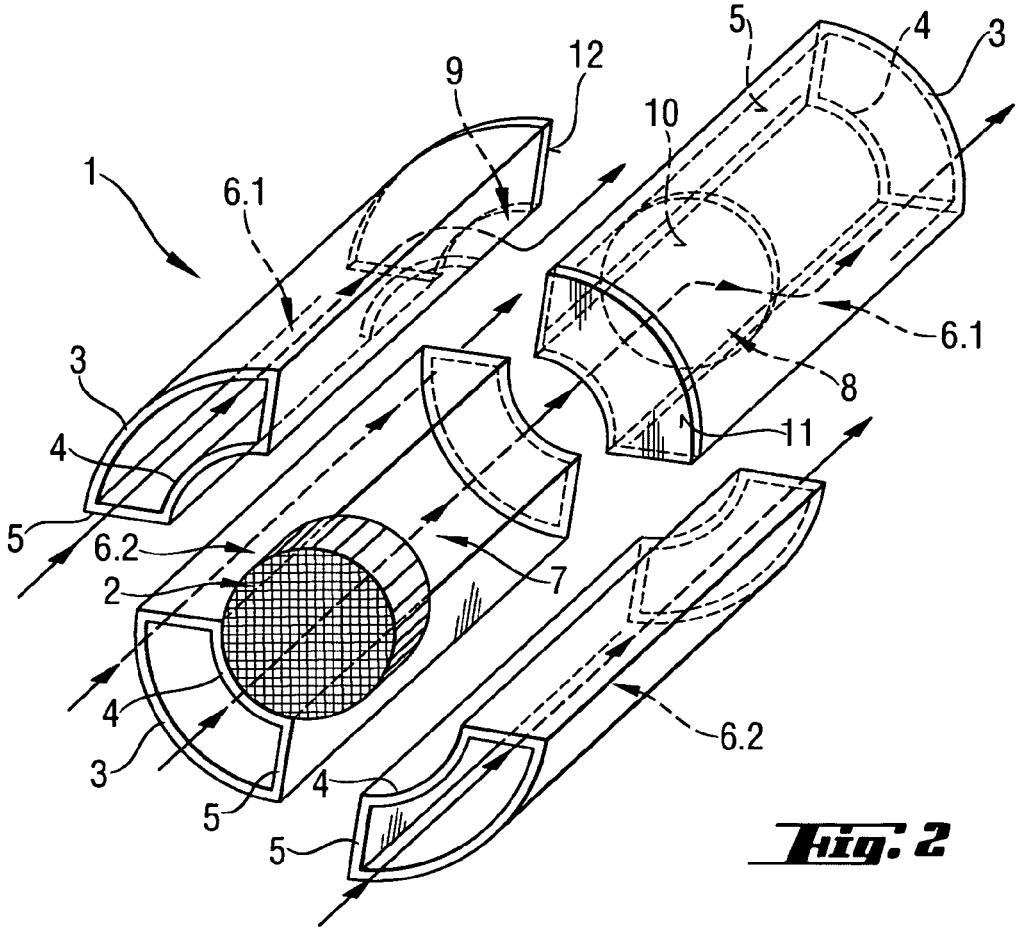
FIG. 2 shows a perspective view of a catalytic converter unit embodying the invention.

In the following the structure of a catalytic converter unit 1 embodying the invention is described with reference to FIGS. 1 and 2. The structure of the catalytic converter unit makes it possible to divide the incoming gas flow into partial flows or streams, one of which may be conducted through a catalytic converter element 2 arranged in the catalytic converter unit 1 while the others are conducted past the catalytic converter element 2. The catalytic converter unit 1 is formed of a pipe 3 having a circular cross-section and functioning as an outer shell. Inside the pipe 3 forming the outer shell is an inner pipe 4 having a smaller diameter than the outer shell and functioning as an inner shell, inside of which the catalytic converter element 2 is located. Although the pipes 3 and 4 are illustrated in the figures with circular cross-section, which is preferred, one or both may alternatively have another, e.g. polygonal, shape. The cross-section of the annular space between the inner and outer shells is divided into uniform sectors with respect to the central axis. In the annular space between the outer shell and the inner shell there are several feed zones 6 that extend in the longitudinal direction of the catalytic converter unit 1 and are defined by preferably radial partition walls 5. The transfer zones 6.1 are arranged so that gas is supplied or discharged through them from a treatment zone 7 formed in the smaller inner pipe 4, which allows the gas to flow through the catalytic converter element 2. For this purpose, openings 8, 9 in the inner pipe 4 connect the treatment zone to the transfer zones 6.1 respectively. The through-flow zones 6.2 are zones through which gas flows straight through the catalytic converter unit 1. The partition walls 5 are arranged at regular angular intervals with respect to the periphery, which makes it possible to provide a catalytic converter apparatus in which several catalytic converter units are connected one after the other, but where the catalytic converter elements are connected in parallel with regard to gas flow. This is disclosed below with reference to FIG. 4.

Downstream of the catalytic converter element 2 in the treatment zone 7, the opening 8 conducts the treated gas away from the treatment zone over to the transfer zone 6.1. In the vicinity of the opening 8 is a partition wall 10 arranged at a distance from the catalytic converter element 2. By means of the partition wall 10 the forward flow of the gas in the treatment zone may be prevented and the gas may be conducted or diverted to the transfer zone 6.1. On the opposite side of the partition wall 10 with respect to the catalytic converter element, the opening 9 conducts a second gas flow from the transfer zone 6.1 to the treatment zone 7. In addition, both the transfer zones 6.1 are plugged by providing them with partition walls 11, 12 so that in one transfer zone the partition wall 11 is located upstream of the opening 8 at the gas inlet end of the catalytic converter unit and in the other the partition wall 12 is located downstream of the opening 9 at the gas outlet end. Thus, the transfer zones are plugged substantially at their opposite ends.

Figure 3:
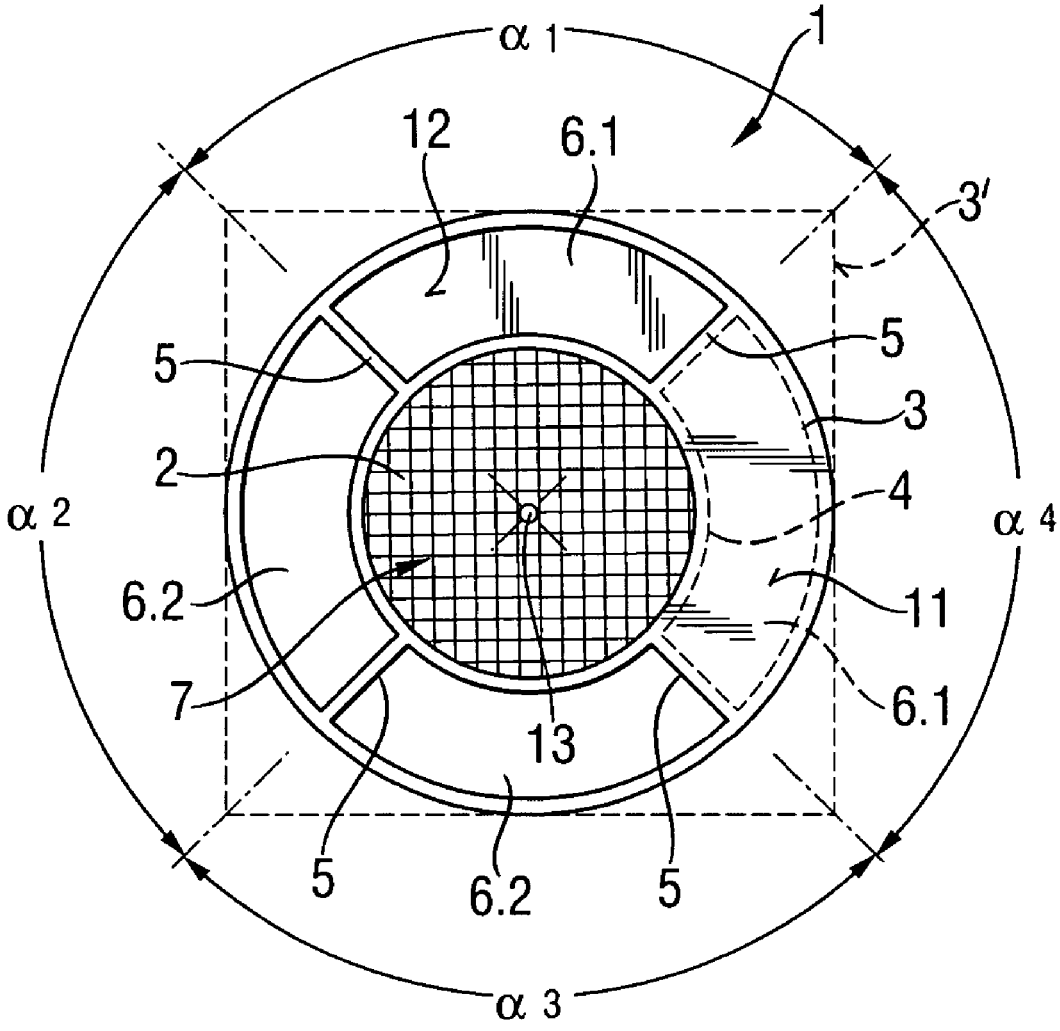
FIG. 3 shows a catalytic converter unit embodying the invention seen from the front.

FIG. 3 shows that the catalytic converter unit 1 has rotational symmetry of order n with respect to its midpoint 13, at least with respect to the locations of the partition walls 5, where n is the number of catalytic converter units in the catalytic converter apparatus and is equal to four in this case. The partition walls 5 are arranged so that the cross-section consists of sectors defined by certain angles $\alpha 1$, $\alpha 2$, $\alpha 3$, $\alpha 4$. All the angles are substantially equal. Thus, the two transfer zones 6.1 and the through-flow zones 6.2 all have similar cross-sections. As mentioned in the above, it is possible to give the inner pipe another shape, or the outer shell 3 as well, e.g. a polygonal outer shell 3' illustrated in FIG. 3 by a dashed line is quite possible.

Several catalytic converter units embodying the invention provide a catalytic converter apparatus for conducting the gas to be treated through several catalytic converter elements that are connected in parallel with respect to gas flow. The catalytic converter apparatus is disclosed in the following with reference to FIG. 4. Gas is supplied through a channel or duct 14 to the first catalytic converter unit 1.1 of the catalytic converter apparatus. As mentioned above, the catalytic converter unit 1.1 divides the flow into several partial flows or streams (four in the case of this example). Two of the four streams of gas enter the through-flow zones 6.2 and flow straight through the unit 1.1. The number of through-flow zones 6.2 depends on the number of catalytic converter units one desires to use, and is always two less than the number of catalytic converter units. In this embodiment the number of catalytic converter units is four and the number of through-flow zones 6.2 is two. A third stream enters one of the transfer zones 6.1. No gas enters the other transfer zone 6.1 because that zone is plugged by the partition wall 11 at the upstream end. The fourth stream of gas flows to the treatment zone 7, where it is treated while flowing through the catalytic converter element 2. Guided by the partition wall 10 and the opening 8, the treated gas passes to the transfer zone 6.1 of the first catalytic converter unit 1.1. After this the stream that has been treated in the first catalytic converter unit 1.1 passes through the next two catalytic converter units 1.2, 1.3 via the through-flow zones 6.2 and then enters the transfer zone 6.1 of the fourth catalytic converter unit 1.4 and passes from the transfer zone through the opening 9 to the treatment zone 7, to the opposite side of the partition wall 10 from the catalytic converter element 2, and finally out to a channel or duct 15. A flow of similar kind, i.e. the treatment of a stream in one catalytic converter unit 2 for each stream at a time, is provided by arranging the catalytic converter units 1.1, 1.2, 1.3, 1.4 one after the other with a downstream unit turned by an angle $\alpha$ around its longitudinal axis relative to the immediately upstream unit, where the angle $\alpha$ is equal to the angle $\alpha 1$, $\alpha 2$, $\alpha 3$, $\alpha 4$. The degree of the angles is determined by the number of sectors. Since in the cross-section all the sectors determined by the angles are similar in shape, the adjacent zones in the direction of rotation are always located one after the other in the successive units.

Figure 4:
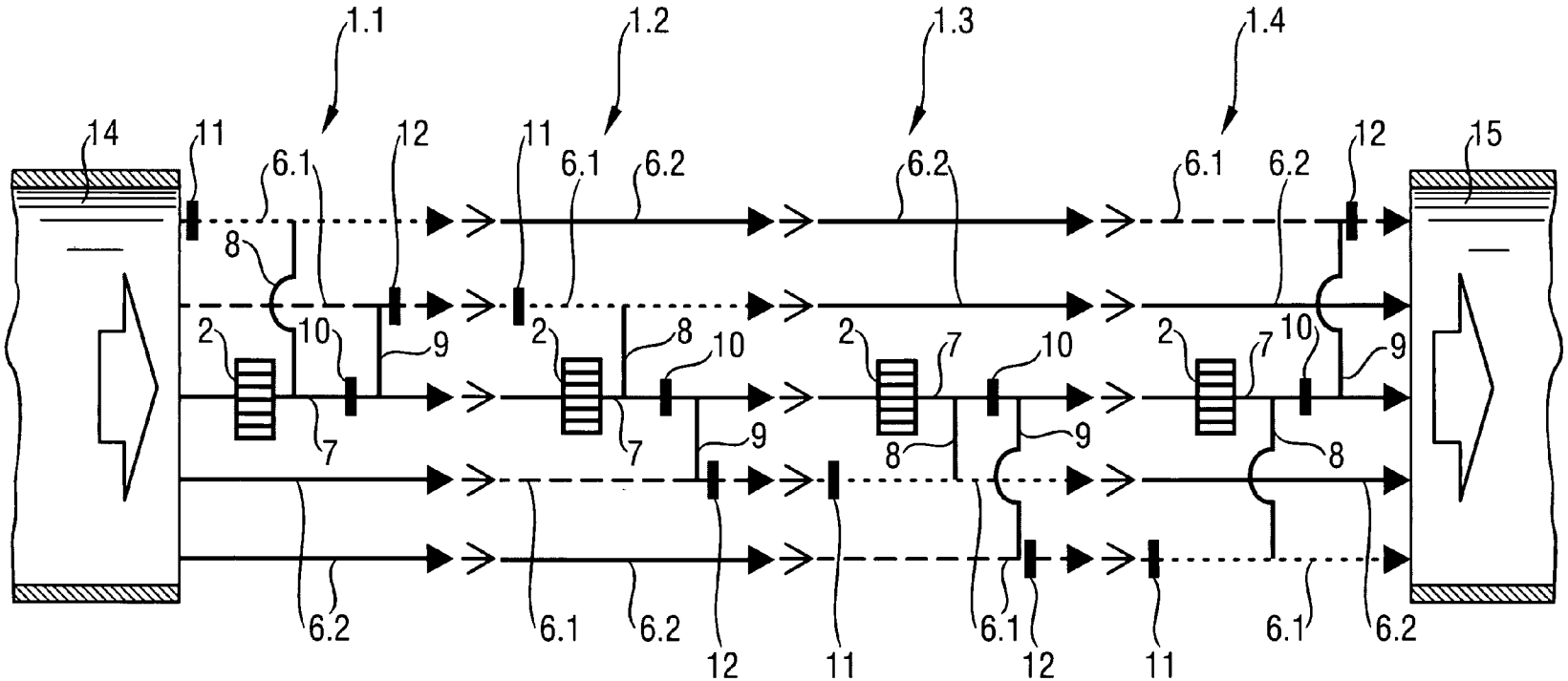
FIG. 4 shows a connection diagram of the catalytic converter units embodying the invention.

It further appears from FIG. 4 that the stream that flows through the transfer zone 6.1 of the first catalytic converter unit 1.1 is led through the opening 9 to the treatment zone 7 downstream of the partition wall 10, whereby this stream is treated in the catalytic converter element 2 of the second catalytic converter unit 1.2. After the treatment, this stream flows through the opening 8 of the second catalytic converter unit 1.2 to the transfer zone 6.1 and further through the through-flow zones 6.2 of the third and fourth catalytic converter units 1.3 and 1.4 out to the channel 15. Similarly, the streams that enter through the through-flow zones 6.2 of the first catalytic converter unit 1.1 are treated in the third and fourth catalytic converter units 1.3 and 1.4 respectively. Thus, the apparatus is such that the treatment zone 7 has several segments that are separated from one another by the partition walls 10, the several segments contain respective catalytic converter elements 2, and each stream passes through one catalytic converter element. In practice, the gas flows as streams in the transfer or through-flow zones surrounding the treatment zone. In the transfer zones direct through-flow is plugged, and the treatment zone 7 provides a by-pass path around the plugging via the catalytic converter element 2 back to the transfer zone 6.1.

As it can be concluded on the basis of FIG. 4, only one of the transfer zones between the catalytic converter units needs to be provided with a partition wall 11, 12, but since both walls are needed at the inlet and outlet ends of the apparatus, it is preferable for practical reasons to use similar catalytic converter units 1.

The invention is not limited to the above-described applications, but several other modifications are conceivable in the scope of the appended claims.

The invention claimed is:

1. A catalytic converter unit, the catalytic converter unit being an elongate unit having an inlet end, for receiving gas to be treated, and an opposite outlet end and comprising:

a wall means comprising an inner shell bounding a treatment zone, an outer shell that laterally surrounds the inner shell in spaced relationship with the inner shell, and a plurality of partition walls dividing the space between the inner and outer shells into first and second transfer zones and at least one through-flow zone, wherein each zone is adjacent at least one other zone and each zone extends from the inlet end to the outlet end, the wall means includes a partition wall that divides the treatment zone into first and second segments, the first segment of the treatment zone is upstream of the second segment of the treatment zone with respect to flow from the inlet end of the catalytic converter unit towards the outlet end thereof, the first transfer zone is plugged at a location that is upstream of the partition wall in the treatment zone, and the second transfer zone is plugged at a location that is downstream of the partition wall in the treatment zone, and a catalytic converter element disposed in the first segment of the treatment zone, spaced from the partition wall, and wherein the first segment of the treatment zone is in flow communication with the first transfer zone and the second segment of the treatment zone is in flow communication with the second transfer zone.

2. A catalytic converter unit according to claim 1, wherein the transfer zones are separated laterally by a common partition wall.

3. A catalytic converter unit according to claim 1, wherein the the inner shell and the outer shell are substantially coaxial and the space defined between the inner and outer shells is substantially annular, and the partition walls that divide the space between the inner and outer shells into said zones are substantially radial and divide the annular space into sectors that form, respectively, the transfer zones and the through-flow zone or zones.

4. A catalytic converter unit according to claim 3, wherein the radial walls are substantially equiangularly distributed in the annular space.

5. A catalytic converter unit according to claim 4, comprising at least four radial walls and wherein one of the radial walls bounds both the first transfer zone and the second transfer zone.

6. A catalytic converter unit according to claim 3, wherein the inner shell is formed with a first opening that is downstream of the catalytic converter element and upstream of the partition wall in the treatment zone and provides communication between the first segment of the treatment zone and the first transfer zone, and with a second opening that provides communication between the second segment of the treatment zone and the second transfer zone.

7. A catalytic converter unit according to claim 1, wherein the first and second transfer zones are plugged substantially at opposite respective ends thereof.

8. A catalytic converter apparatus including a plurality of substantially cylindrical catalytic converter units each comprising a catalytic converter element and a wall means defining a treatment zone, first and second transfer zones and at least one through-flow zone, wherein the zones are adjacent each other, the wall means includes a partition wall that divides the treatment zone into a first segment in flow communication with the first transfer zone and a second segment in flow communication with the second transfer zone, the first transfer zone is plugged upstream of the partition wall and the second transfer zone is plugged downstream of the partition wall, and the catalytic converter element is disposed in the first segment of the treatment zone, spaced from the partition wall, and wherein the catalytic converter units are connected end-to-end between an inlet end of the apparatus and an outlet end thereof and in each pair of catalytic converter units composed of an upstream unit and an adjacent downstream unit, the first transfer zone of the upstream unit is aligned with a through-flow zone of the downstream unit and the second transfer zone of the upstream unit is aligned with the first transfer zone of the downstream unit.

* * * * *